United States Patent [19]

Stevens

[11] Patent Number: 4,586,205

[45] Date of Patent: May 6, 1986

[54] SOFA-SLEEPER HAVING A REMOVABLE SOFA BED MECHANISM

[75] Inventor: John E. Stevens, Carthage, Mo.

[73] Assignee: Leggett & Platt, Incorporated, Carthage, Mich.

[21] Appl. No.: 639,105

[22] Filed: Aug. 9, 1984

[51] Int. Cl.[4] ..... A47C 17/04; A47C 17/00

[52] U.S. Cl. ..... 5/13; 5/51 B

[58] Field of Search ..... 5/13, 51 B, 300; 403/329

[56] References Cited

U.S. PATENT DOCUMENTS

| | | | |
|---|---|---|---|
| 1,182,610 | 5/1916 | Wiesman . | |
| 1,383,485 | 7/1921 | Richardson | 5/13 |
| 1,504,763 | 8/1924 | Hultgren | 5/51 B |
| 1,824,773 | 9/1931 | Duvall | 5/51 B |
| 2,584,146 | 2/1952 | Martin | 5/13 |
| 2,650,656 | 9/1953 | Ohlsson . | |
| 2,793,407 | 5/1957 | Johnston . | |
| 3,785,110 | 1/1974 | Galloway et al. | 403/329 |
| 3,854,153 | 12/1974 | Fadler et al. . | |
| 3,906,557 | 9/1975 | Barabas | 5/13 |

*Primary Examiner*—Thomas J. Holko
*Assistant Examiner*—Michael F. Trettel
*Attorney, Agent, or Firm*—Wood, Herron & Evans

[57] ABSTRACT

A sofa-sleeper includes a stationary sofa frame having a front, back and opposed sides, and a sofa bed mechanism including pivotally interconnected head, body, intermediate and foot frame sections which are extendable to form a bed and foldable within the sofa frame to form a seat. The sofa bed mechanism is removably mounted upon the stationary sofa frame by dove-tail shaped brackets mounted on opposed sides of the sofa frame, and a pair of tapered mounting plates pivotally connected on opposite sides of the sofa bed mechanism to the head and body frame sections. The tapered mounting plates of the sofa bed mechanism are adapted to slide into the dove-tail shaped brackets of the sofa frame, and are releasably locked therein by a tab formed on each mounting plate which snap fits within a mating slot formed in each bracket.

5 Claims, 5 Drawing Figures

SOFA-SLEEPER HAVING A REMOVABLE SOFA BED MECHANISM

BACKGROUND OF THE INVENTION

This invention relates to sofa-sleepers, and more particularly, to a releasable connection between the foldable sofa bed mechanism and the stationary sofa frame of a sofa-sleeper.

Foldable sofa-sleepers include a foldable sofa bed mechanism having pivotally interconnected head, body, intermediate and foot frame sections which is adapted to mount on a stationary sofa frame. The sofa frame of prior sofa-sleepers is formed with a back rest cushion, a pair of side rails and a fixed front rail which define a generally rectangular storage enclosure for the folded sofa bed assembly. The frame sections of the sofa bed assembly are movable between a fully folded or retracted position within the sofa frame and an extended position wherein the sections extend out and over the front rail of the sofa frame to form a bed.

In prior sofa-sleepers, as for example the sofa sleeper of U.S. Pat. No. 3,854,153, the foldable sofa bed mechanism is generally mounted to the stationary sofa frame by a pair of opposed angles mounted to the head and body frame sections of the sofa bed mechanism and then to the side rails of the sofa frame. The mounting angles are usually riveted or pinned to the head and body frame sections of the sofa bed mechanism, and the mounting angles are essentially permanently fixed to the side rails of the sofa frame by screws, bolts, nails or similar connections. The problem with such a prior art connection between the sofa bed mechanism and sofa frame is that it is essentially permanent and does not permit easy disassembly of the sofa bed mechanism from the sofa frame for repair of the upholstered portions of the sofa frame or any part of the sofa bed mechanism.

SUMMARY OF THE INVENTION

It has been an objective of this invention to provide a sofa-sleeper having a releasable mounting arrangement between the foldable sofa bed mechanism and stationary sofa frame to permit disassembly of the sofa-sleeper for repair or replacement of either the sofa bed mechanism or the sofa frame.

The sofa-sleeper of this invention which accomplishes this objective comprises a foldable sofa bed mechanism and a stationary sofa frame. The sofa frame includes front, back and opposed side rails forming a generally rectangular enclosure, which are preferably formed of wood. The sofa bed mechanism includes pivotally interconnected head, body, intermediate and foot frame sections which are extendable to form a bed and foldable within the sofa frame to form a seat. The sofa bed mechanism is removably mounted upon the stationary sofa frame by mating brackets and mounting plates. A pair of brackets are mounted to the sofa frame, one on the interior surface of each of the opposed side rails. A mounting plate is pivotally connected on opposite sides of the sofa bed mechanism to members of the head and body frame sections. The mounting plates of the sofa bed mechanism are adapted to be inserted within the sofa frame brackets for removably mounting the mechanism upon the sofa frame. Preferably, means are provided for releasably locking the mounting plates in place upon insertion within the brackets.

The ends of each sofa frame bracket are formed with dove-tail shaped tapered grooves and the ends of the mounting plates of the sofa bed mechanism are formed with tapered ends so that the mounting plates slide into the brackets and become wedged within the brackets for releasably securing the sofa bed mechanism to the sofa frame.

Each of the mounting plates is formed with an outwardly extending tab near one end which is adapted to snap-fit within a mating slot formed in each bracket. The tab and slot connection releasably locks the mounting plates in place within the brackets so that the sofa bed mechanism is secured in place within the sofa frame.

DESCRIPTION OF THE DRAWINGS

The structure, operation and advantages of this invention will become further apparent upon consideration of the following description taken in conjunction with the accompanying drawings, wherein.

DETAILED DESCRIPTION OF THE INVENTION

Figure 1:
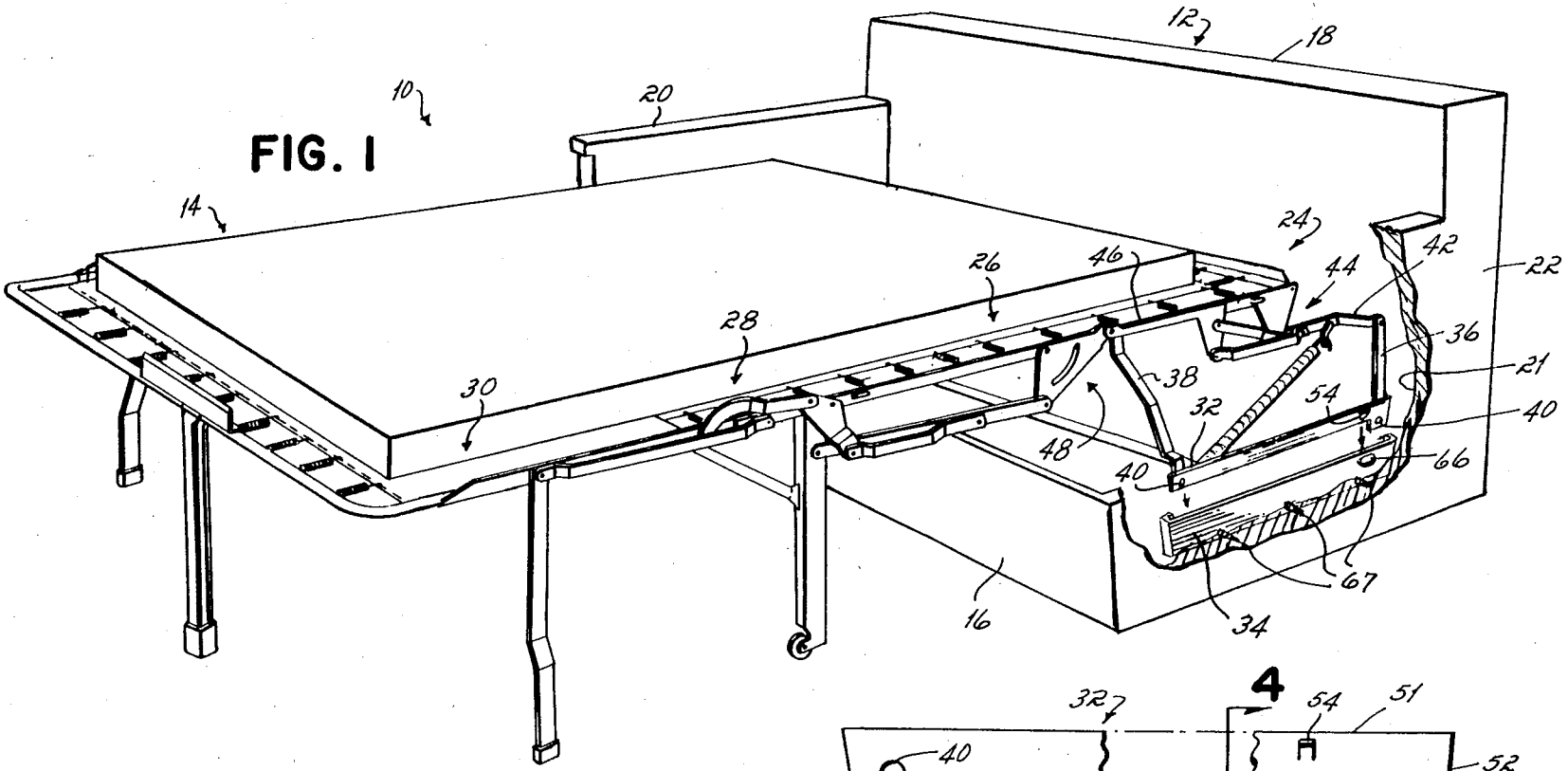
FIG. 1 is perspective view of a sofa-sleeper incorporating the connection between the sofa bed mechanism and sofa frame of this invention.

Referring now to the drawings, a sofa-sleeper 10 comprises a stationary sofa frame 12 and a foldable sofa bed mechanism 14. The sofa frame 12 is a standard upholstered frame including a front rail 16, back rest cushion 18, and opposed side arms 20, 22 preferably formed of wood. The sofa bed mechanism 14 includes pivotally interconnected and transversely arranged bed frame head section 24, body section 26, intermediate section 28, and a foot section 30. The pivotal connections and foldable operation of the sofa bed mechanism 14 form no part of this invention, and may comprise any well-known standard sofa bed mechanism construction such as shown in U.S. Pat. No. 3,854,153.

The sofa bed mechanism 14 is removably mounted within the sofa frame 12 by a pair of opposed mounting plates 32 pivotally attached thereto, which are adapted to be releasably inserted into a pair of opposed brackets 34 secured to the interior surface 21 of side arms 20, 22 of the sofa frame 12 as described below. Only one of the mounting plates 32 and brackets 34 is shown in FIG. 1, it being understood that identical elements are provided on the opposite side of the mechanism 14 and on the opposite side arm 20.

Figure 2:
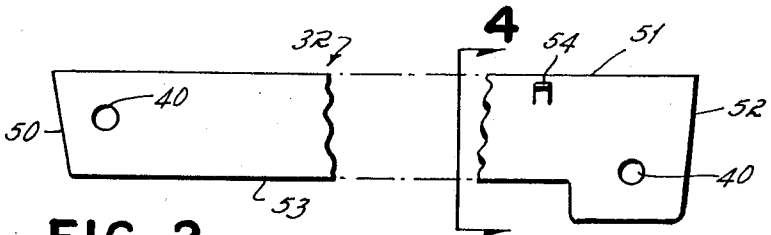
FIG. 2 is a front view of the mounting plate which is attached to the sofa bed mechanism herein.
Figure 4:
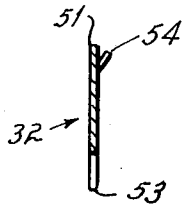
FIG. 4 is a cross-sectional view of a mounting plate herein taken generally along line 4—4 of FIG. 2.

As shown in FIG. 2, the mounting plate 32 comprises a thin elongate section having dove-tail shaped ends 50 and 52 which taper inwardly from the top edge 51 of mounting plate 32 to its bottom edge 53. The rearward end 52 disposed near the back rest cushion 18 is slightly longer than the forward end 50. A cutout or tab 54 is formed in the mounting plate 32 near its forward end 52 and extends outwardly at an angle from the surface of mounting plate 32 (see FIG. 4).

The mounting plate 32 is connected to the sofa bed mechanism 14 by a rear hanger arm post 36 forming part of the head frame section 24, and a main pilot arm 38 which forms a part of the body frame section 26 of sofa bed assembly 12. The rear hanger arm post 36 is pivotally mounted to the rearward end 52 of mounting plate 32, and main pilot arm 38 is pivotally mounted to the forward end 50 thereof by rivets 40. The opposite end of rear hanger arm post 36 is pivotally connected to a link 42, which forms a part of the pivot linkage 44 of head frame section 24. The opposite end of the main pilot arm 38 is pivotally connected to a pilot actuating arm 46 which forms part of the linkage assembly 48 for pivoting the body frame section 26 relative to the head frame section 24. The pivot linkage 44 and body section linkages 48 do not form a part of this invention and are described briefly herein for purposes of illustrating the connection between mounting plates 32 and sofa bed mechanism 14. The structure and operation of linkages 44, 48, and of the remainder of sofa bed assembly 14, is described in detail in prior patents of the assignee such as U.S. Patent No. 3,854,153.

Figure 3:
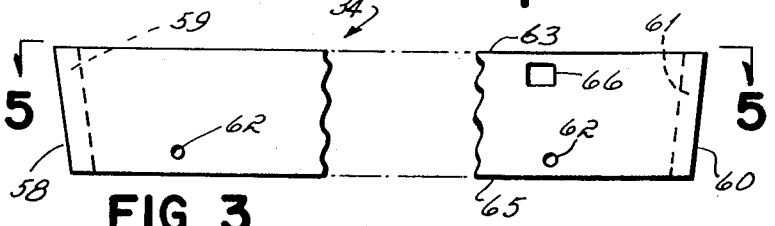
FIG. 3 is a partial front view of the mounting bracket herein.
Figure 5:
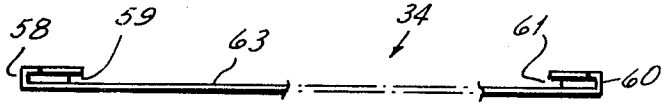
FIG. 5 is a plan view of the mounting bracket of this invention.

The bracket 34 is formed in a shape to mate with the mounting plate 32. As shown in FIGS. 3 and 5, the bracket 34 includes an elongate center section disposed between opposed ends 58, 60 which are formed with dove-tail shaped slideways 59, 61, respectively. The slideways 59, 61 taper inwardly from the top edge 63 to the bottom edge 65 of bracket 34. The slideways 59, 61 are adapted to receive the tapered ends 50, 52 of mounting plate 32 so that the mounting plate 32 becomes wedged in place with the slideways 59, 61 when slid within bracket 34. The bracket 34 is formed with bores 62 through which nails or screws 67 are inserted and fixed within the interior surface 21 of side arm 22 of sofa frame 12 to secure the bracket 34 thereto.

In order to releasably lock the mounting plate 32 within bracket 34 so that the sofa bed frame 14 can be extended and retracted from the sofa frame 12 without lifting the mounting plates 32 out of the brackets 34, the bracket 34 is formed with a slot 66 which is adapted to mate with the tab 54 formed in mounting plate 32. As the mounting plate 32 is slid within bracket 34 by moving the sofa bed mechanism 14 vertically downwardly within the sofa frame 12, the tab 54 snaps within the slot 66 so as to lock the mounting plate 32 within the bracket 34. The mounting plate 32 may be removed from the bracket 34 by urging the tab 54 toward the surface of mounting plate 32 and out of the slot 66, and then lifting the mounting plate 32 vertically upwardly out of the bracket 34. This releasable connection between the mounting plate 32 and bracket 34 facilitates removal of the sofa bed assembly 14 from the sofa frame 12 for repair or replacement of either element.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A sofa-sleeper comprising a stationary sofa frame having front, back and opposed sidewalls, a sofa bed mechanism having pivotally interconnected body, intermediate and foot frame sections, said frame sections of said sofa bed mechanism being extendable to form a bed and foldable within said sofa frame to form a seat, an elongated sofa bed mechanism supporting bracket mounted on the interior surface of each of said opposed sidewalls of said sofa frame, each of said brackets including top and bottom edges and opposite ends, said opposite ends of each of said elongated brackets being located adjacent the front and back of said sofa frame, each of said elongated brackets being formed as a single dove-tail shaped slideway having inwardly sloping surfaces at each of said opposite ends, an elongated mounting plate pivotally connected to said head and body frame sections of said sofa bed mechanism on each side of said sofa bed mechanism, each of said mounting plates having opposed ends with inwardly sloping surfaces adapted to be inserted within said dove-tail shaped slideways of said brackets of said sofa frame engaged with said inwardly sloping surfaces of said bracket for removably mounting said sofa bed mechanism upon said sofa frame.

2. The sofa sleeper of claim 1 wherein each of said mounting plates has a forward and a rearward end, each of said forward ends of such mounting plates being connected by a pivot linkage to said body frame section of said mechanism and each of said rearward ends of said mounting plates being connected to said head section of said mechanism by a pivot linkage.

3. A sofa sleeper as in claim 1 in which said dove-tail shaped slideways taper inwardly from said top edge to said bottom edge of said brackets, said mounting plates having top and bottom edges, and said opposed ends of said mounting plates tapering inwardly from said top edge to said bottom edge thereof.

4. A sofa-sleeper as in claim 1 further including means for releasably locking said mounting plates within said brackets.

5. A sofa-sleeper as in claim 4 in which said locking means comprises a slot formed in one of said brackets and mounting plates and an outwardly extending tab formed in the other of said brackets and mounting plates, said tabs being adapted to snap-fit within said slots upon insertion of said mounting plates within said brackets.

* * * * *